US006982693B2

(12) United States Patent
Okuzono et al.

(10) Patent No.: US 6,982,693 B2
(45) Date of Patent: Jan. 3, 2006

(54) LIQUID CRYSTAL DISPLAY

(75) Inventors: Noboru Okuzono, Tokyo (JP); Koichi Koga, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 0 days.

(21) Appl. No.: 10/762,502

(22) Filed: Jan. 23, 2004

(65) Prior Publication Data

US 2004/0150604 A1 Aug. 5, 2004

Related U.S. Application Data

(62) Division of application No. 09/772,864, filed on Jan. 31, 2001, now Pat. No. 6,727,878.

(30) Foreign Application Priority Data

Feb. 4, 2000 (JP) ..... P2000-028079

(51) Int. Cl.
*G09G 3/36* (2006.01)

(52) U.S. Cl. ..... 345/96; 345/209

(58) Field of Classification Search ..... 345/87, 345/92, 94–97, 208–210
See application file for complete search history.

(56) References Cited

U.S. PATENT DOCUMENTS 5,646,641 A 7/1997 Okamura et al.
5,719,590 A 2/1998 Shimada et al.
5,883,608 A 3/1999 Hashimoto
6,075,505 A 6/2000 Shiba et al.
6,084,562 A 7/2000 Onda
6,307,532 B1 10/2001 Aoki
6,501,454 B1 12/2002 Ozawa et al.
2001/0043178 A1 * 11/2001 Okuzono et al. ..... 345/87

FOREIGN PATENT DOCUMENTS

JP 9-15560 1/1997
JP 09015560 * 1/1997
JP 9-127920 5/1997

* cited by examiner

*Primary Examiner*—Ricardo Osorio
(74) *Attorney, Agent, or Firm*—McGinn IP Law Group, PLLC

(57) ABSTRACT

A liquid crystal display is provided which has low power consumption, and which prevents horizontal stripes from occurring without the circuitry becoming more complex. When the write voltage polarity is inverted every plurality of lines, in the n line where the polarity is inverted, the rise in the drain line waveform dulls due to the charging of the drain line. In the n+1 line, because the drain line has been charged by the writing of the n line, waveform dullness does not occur. A difference between the write states in the two lines causes horizontal stripes. Consequently, the output enable signal is activated at the rise of the clock signal, and the gate line is activated after a predetermined time to start the writing. Therefore, writing is not performed during the period of waveform dullness, and the write state is the same across all scan lines.

11 Claims, 10 Drawing Sheets

FIG. 2

| | | | | | | |
|---|---|---|---|---|---|---|
| n | POSITIVE | NEGATIVE | POSITIVE | NEGATIVE | POSITIVE | NEGATIVE |
| n+1 | POSITIVE | NEGATIVE | POSITIVE | NEGATIVE | POSITIVE | NEGATIVE |
| n+2 | NEGATIVE | POSITIVE | NEGATIVE | POSITIVE | NEGATIVE | POSITIVE |
| n+3 | NEGATIVE | POSITIVE | NEGATIVE | POSITIVE | NEGATIVE | POSITIVE |
| n+4 | POSITIVE | NEGATIVE | POSITIVE | NEGATIVE | POSITIVE | NEGATIVE |
| n+5 | POSITIVE | NEGATIVE | POSITIVE | NEGATIVE | POSITIVE | NEGATIVE |

FIG. 4

| /VOE MASKING TIME A [μs] | 127 TONE | 63 TONE |
|---|---|---|
| 0 | △ | △ |
| 1.26 | ○ | △ |
| 2.5 | ○ | ○ |
| 5.0 | ○ | ○ |

○: NO HORIZONTAL STRIPES

△: FAINT HORIZONTAL STRIPES

×: HORIZONTAL STRIPES

LIQUID CRYSTAL DISPLAY

This is a divisional of application Ser. No. 09/772,864, filed Jan. 31, 2001, now U.S. Pat. No. 6,727,878.

BACKGROUND OF THE INVENTION

1. Field of the Invention

The present invention relates to a dot matrix type liquid crystal display, and in particular, an active matrix type liquid crystal display where the polarity of the write voltage which is applied to the liquid crystal cell is inverted after every plurality of scan lines.

2. Description of the Related Art

Of the liquid crystal displays commonly used, types such as STN (Super Twisted Nematic) and TFT (Thin Film Transistor) are representative. Of these types, an STN type liquid crystal display uses a passive matrix drive. In other words, with a passive matrix drive, the liquid crystal panel is constructed of electrodes and liquid crystal without the provision of switching elements, and the liquid crystal of each pixel positioned in the matrix is driven with time-division in synchronization with a scan signal.

In contrast, TFT type liquid crystal displays are active matrix driven. In other words, with an active matrix drive, by positioning switching elements comprising active elements such as TFTs at each pixel, it becomes possible to isolate the ON pixels and the OFF pixels and hold the voltage applied to the ON pixels, and drive with time division and synchronize the liquid crystal of each pixel positioned in the matrix with a scan signal. Because this method offers good contrast and response, and high image quality and large displays can be easily realized, recently active matrix type liquid crystal displays have become predominant.

From this point, discussion will center on active matrix type liquid crystal displays. Firstly, liquid crystal displays use a line-sequential driving method, where a single screen image is displayed by driving the scan lines in sequence from the uppermost scan line toward the lowest scan line. Moreover, this one screen is generally called a frame (or a field). Furthermore, in a liquid crystal display, when the liquid crystal cells are driven, in order to prevent the liquid crystal material from deteriorating, the polarity of the write voltage applied to the liquid crystal cells is inverted after a predetermined amount of time elapses, resulting in driving by an alternating current.

Here, the timing of the inversion of the polarity of the write voltage can be performed on either a frame by frame basis, a scan line by scan line basis, or a pixel (dot) by pixel basis, and these are known as frame inversion drive, line inversion drive and dot inversion drive respectively. Of these methods, the most fundamental driving method is frame inversion drive, where the polarity of the write voltage to be applied to each pixel is changed for every frame. In other words, if a specific pixel in a certain frame is driven with a positive polarity, then after the driving of the whole frame has been performed, if the same pixel is to be driven again, it will be driven with a negative polarity.

In contrast, line inversion drive and dot inversion drive are methods where the polarity can be inverted even within one frame. Of these, with line inversion drive (more accurately, one line inversion drive), if a certain scan line is driven with positive polarity, then the next scan line directly below this scan line is driven with negative polarity, and the following scan line is again driven with positive polarity. Dot inversion drive is a method where the polarity is inverted for every pixel on each scan line, and with two adjacent liquid crystal cells as a unit, the polarity of the write voltage is changed alternately.

However, when the polarity of the write voltage has been inverted, it is necessary for the drain line for supplying this write voltage to the liquid crystal cell to be charged from a negative polarity voltage to a positive polarity voltage, or alternatively, discharged from a positive polarity voltage to a negative polarity voltage. Consequently, with line inversion drive, the charging and discharging of the drain lines is performed frequently, and power consumption increases. Hence, if the polarity of the write voltage is inverted for each single scan line as described above, then the increase in power consumption will be quite marked.

If frame inversion drive is used, then power consumption can be reduced, but because in this case voltage of the same polarity is continually held in the liquid crystal cell for the period of one frame, a different problem occurs in that the display level of the pixel is disrupted by current leakage from the TFT. Because of this, recently as a compromise, "Multiple Line Inversion Drive" where the polarity of the write voltage is inverted after every plurality of lines is beginning to be used. However, in this type of multiple line inversion drive also, there are problems as described below.

Here, FIG. 9 shows the structure of essential sections of a liquid crystal display according to related art, and here only those matters pertaining to the problems of this related art will be described. Firstly, each pixel comprises a TFT 100 and a liquid crystal cell 101 as shown in the figure. Each pixel is placed at a point of intersection between a plurality of gate lines 102 which run in rows (the scanning direction) and a plurality of drain lines 103 which run in columns, and these pixels form a liquid crystal panel 104.

A gate driver 105, by sequentially supplying a drive voltage to the gate line 102, controls the conduction state of the TFTs 100 which are connected to each gate line. Furthermore, a source driver 106, by supplying a write voltage to the drain line 103, conducts writing to each of the liquid crystal cells 101 via the TFT 100 driven by the gate driver 105. Moreover, a timing controller 107 transmits a variety of control signals to the gate driver 105 and the source driver 106. Furthermore, a fixed voltage is applied to a common electrode 108, which is connected to one end of the liquid crystal cell 101.

Next, FIG. 10 shows a timing waveform of the liquid crystal display shown in FIG. 9 when a two line inversion drive is used. In the figure, a clock signal VCK is used by the gate driver 105 to sequentially activate the gate lines 102. Furthermore, a latch pulse signal STB is a timing signal for transmitting one scan line of image data taken into the source driver 106 to the drain line 103. Here, in the frame directly before the frame corresponding with the timing shown in FIG. 10, a write voltage of a negative polarity is assumed to have been applied to the nth and the nth+1 scan lines. Moreover, the nth scan line (gate line) will be referred to simply as the n line in the following description, and the other scan lines will be referred to in the same manner.

Firstly, when the clock signal VCK rises at time t100, the drive voltage shown as the "n line gate waveform" is applied to the n line, and the pixels connected to this gate line are selected. Next, when the latch pulse signal STB falls at time t101, the write voltage corresponding with the image data on the n line is applied to the drain line 103, and writing commences to the liquid crystal cell 101 which is connected to this n line.

However, this case describes the situation immediately following an inversion of the polarity of the write voltage, and in addition to the capacity of the liquid crystal cell 101 the capacity of the drain line 103 must also be charged (or in the case of the transition from write voltage of a positive polarity to write voltage of a negative polarity, must be discharged). Consequently, the voltage of the drain line 103 gradually rises from a write voltage of a negative polarity to a write voltage of a positive polarity, until a time t102 when the rise of the voltage finally stops.

Subsequently, when a time t103 is reached following the elapsing of a time T, which corresponds to one horizontal period on the screen, from the time t100, the drive voltage is no longer applied to the n line, and instead the drive voltage represented by the "n+1 line gate waveform" is applied to the n+1 line. Next, when the latch pulse signal STB falls at a time t104, then in the same manner as with the n line, the write voltage corresponding with the image data is supplied to the drain line 103.

In fact, at this point in time, the drain line 103 has already been charged to voltage of a positive polarity by the writing to the n line. Consequently, only the capacity of the liquid crystal cell 101 needs to be charged (or discharged) in the n+1 line, and the drain line waveform becomes a flat waveform which remains at approximately the same electrical potential. When the latch pulse signal STB falls at a time t105 which is reached following the elapsing of the time T from time t104, the voltage of the drain line 3 changes from a voltage of a positive polarity to a voltage of a negative polarity for writing to the n+2 line.

As described above, because extra time is taken in the n line to charge the capacity of the drain line 103, waveform dullness occurs in the rising portion of the drain line waveform (time t101–t102). In contrast, because there is no need to charge the capacity of the drain line 103 in the n+1 line, waveform dullness such as that observed in the case of the n line does not occur (time t104-).

Regardless of these differences, in liquid crystal displays according to related art, each of the gate lines is driven in the same manner, and the write period for each scan line is always fixed as the time T. Therefore, for example, the write states of the liquid crystal cells 101 of the n line and the n+1 line differ. In other words, the holding voltage of the liquid crystal cell connected to the n+1 line reaches the voltage corresponding with the image data output by the source driver 106 because the write period is sufficient. In contrast, the holding voltage of the liquid crystal cell connected to the n line does not reach the voltage corresponding with the image data because a sufficiently substantial write period cannot be secured due to the effects of waveform dullness.

Here, because if the holding voltage of the liquid crystal is lower the brightness of the pixels is that much lower, the brightness of the n line will be lower than the brightness of the n+1 line. Because this phenomenon also occurs in the other scan lines, the brightness of the pixels can differ for each scan line, and on screen this appears as horizontal stripes. Consequently, with a liquid crystal display operating at high resolution, the shorter one horizontal period (time T) is made, the less the influence of the rising portion in the drain line waveform can be ignored, and the more marked the horizontal stripes will become.

In Japanese Unexamined Patent Application, First Publication No. Hei 9-15560 (hereafter referred to as the "well-known art"), for those scan lines where the polarity of the write voltage is inverted, the length of one horizontal period is longer than that of the other scan lines. As a result, the difference between the write state when writing with the same polarity and that when writing with the opposite polarity is reduced, and the occurrence of horizontal stripes can be alleviated.

However, to change the length of one horizontal period as in the aforementioned well-known art, the cycle of the clock signal which serves as a reference in the liquid crystal display (hereafter referred to as the "reference clock signal") must be adjustable. However, in conventional liquid crystal displays, circuit design is performed under the premise that one horizontal period is fixed. Consequently, if the cycle of the reference clock signal is made adjustable, it becomes difficult to avoid making the circuit structure (particularly the circuit block corresponding with the timing controller 107 shown in FIG. 9) more complicated.

Furthermore, the following problem also occurs with the aforementioned well-known art. In short, with the aforementioned well-known art, in the scan lines where the polarity of the write voltage is inverted, the horizontal scanning period is expanded by a predetermined amount of time. However, because the number of scan lines in one frame is fixed and unchangeable, to compensate for the expanded time span, the horizontal scanning periods of the other scan lines must be reduced. For example, because in the above well-known art the polarity of the write voltage is inverted every three lines, of these three scan lines, the horizontal scanning period of two of these scan lines must be shortened.

In order to write image data of the same number of pixels to the liquid crystal cells even though the horizontal scanning period has been reduced, the frequency of a clock signal for taking in the image data (hereafter referred to as the "data intake clock signal") must be raised. However, in the aforementioned well-known art, the horizontal scanning period of the scan lines where the polarity of the write voltage is inverted is expanded by 1.1–1.4 times. As a result, the operating frequency for each section in the device (in particular the circuit block corresponding with the timing controller 107 and the source driver 106 shown in FIG. 9) must be increased by a considerable amount, and this becomes a hindrance during circuit design and layout design. In addition, as a result of the increase in the operating frequency, it becomes inevitable that EMI (Electro-Magnetic Interference) noise countermeasures will be required.

SUMMARY OF THE INVENTION

In view of the above circumstances, an object of the present invention is to provide a liquid crystal display for which power consumption is low due to multiple line inversion drive, and moreover which is capable of high quality image display by preventing the occurrence of horizontal stripes without the circuitry such as that of the timing controller becoming more complex.

In the present invention, in the scan lines where the polarity of the write signal is inverted, then following the elapsing of a predetermined time after the supply of a write signal of an opposite polarity to the polarity of the voltage of the data lines begins, the drive signal is supplied to the data lines, and also with the other following scan lines, the drive signal is supplied for the same time as the time that the drive signal is supplied to the scan lines where the polarity of the write signal is inverted. As a result, the dull portions of the voltage waveform of the data lines can be masked, and the write states for the liquid crystal cells can be made constant for all scan lines. Consequently horizontal stripes caused by the difference in brightness between the scan lines no longer occur, and the display grade improves.

Furthermore, according to the present invention, in the following scan lines other than those scan lines where the polarity of the write signal is inverted, the drive signal is supplied for a period of time that is shorter, by a predetermined amount of time, than the time for which the drive signal is supplied to the scan lines where the polarity of the write signal is inverted. Consequently, because the write states for the liquid crystal cells can be made constant for all scan lines, horizontal stripes caused by the difference in brightness between the scan lines no longer occur, and the display grade improves. Moreover, because the time for which the drive signal is supplied to the scan lines where the polarity of the write signal is inverted has not been shortened, there is no reduction in the brightness.

Furthermore, according to the present invention, in the scan lines where the polarity of the write signal is inverted, the drive signal and the write signal are supplied for a period of time that is longer than one horizontal period by a fixed amount of time that is within the range of the invalid period, and the drive signal and the write signal are supplied to the other following scan lines for a period of time shorter than one horizontal period by the aforementioned fixed amount of time. As a result, because the write state of the liquid crystal cells can be made constant for all scan lines, horizontal stripes caused by the difference in brightness between the scan lines no longer occur, and the display grade improves. Furthermore, because the period of time for which the drive signal and the write signal are supplied is lengthened and shortened within the range of the invalid period, the need for the data line drive circuit to alter the frequency of the dot clock signal for taking in the image data is completely eliminated.

Moreover, in the invention described above, by adjusting the period for which the drive signal or the write signal is supplied until horizontal stripes cannot be perceived on the display based on a visual assessment, flexible adjustment becomes possible even if there is variation in the characteristics of each part of the liquid crystal display, and the brightness can be raised as far as possible provided horizontal stripes cannot be perceived by a visual assessment.

BRIEF DESCRIPTION OF THE DRAWINGS

FIG. 2 is an explanatory drawing showing the polarity of the voltage of the image data written to each pixel within a certain frame in the case where two line dot inversion drive is used.

FIG. 4 is a table showing the result of a check of the degree of the occurrence of horizontal stripes in the case where two line dot inversion drive has been implemented with a 60 Hz frame frequency and SXGA standard.

DETAILED DESCRIPTION OF THE PREFERRED EMBODIMENTS

As follows, preferred embodiments of the present invention will be described in sequence with reference to the drawings.

[First Embodiment]

(1) Description of the Construction

Figure 1:
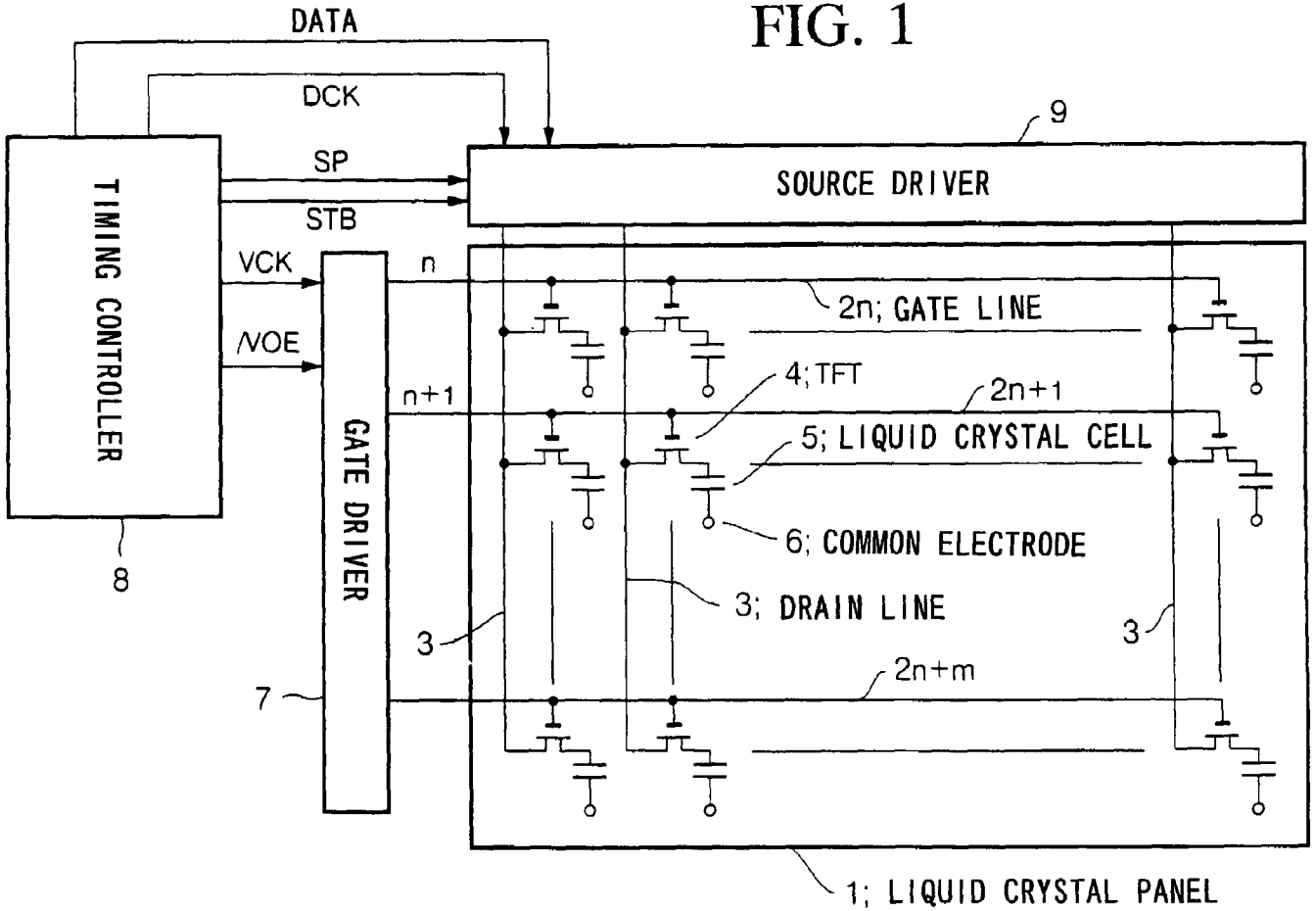
FIG. 1 is a block diagram showing the construction of essential sections of a liquid crystal display according to each embodiment of the present invention.

FIG. 1 is a block diagram showing the construction of essential sections of a liquid crystal display according to the first embodiment of the present invention. Numeral 1 in the figure is a liquid crystal panel, in which a gate line 2*n*, a gate line 2*n*+1, . . . , a gate line 2*n*+m which run in rows and drain lines 3, . . . , 3 which run in columns are provided.

Of these, each of the gate lines corresponds with a respective scan line. Furthermore, the image data for performing screen display on the liquid crystal panel 1 is supplied to the drain lines 3. Consequently, the drain lines 3 are sometimes also called data lines. Pixels are arranged in a matrix at those positions where the gate lines and the data lines intersect.

Each of these pixels comprises a TFT 4 and a liquid crystal cell 5. A gate terminal, a drain terminal and a source terminal of the TFT 4 are connected respectively to the gate line 2*n*, the drain line 3 and one side of the liquid crystal cell 5. One side of the liquid crystal cell 5 is connected to the source terminal of the TFT 4, and the other side is connected to a common electrode 6. In addition to performing the display of one dot, the liquid crystal cell 5 also comprises the capacity for holding a write voltage supplied from a source driver 9 (to be described below) through the drain line 3.

Here, because the transmittance of the light passing through the liquid crystal cell 5 changes according to the level of the write voltage applied thereto, by using this property and changing the level of the write voltage appropriately, the brightness of the pixel can be set to the desired state. Furthermore, a fixed voltage, for example 7V, is applied to the common electrode 6, and the polarity (positive polarity or negative polarity) of the write voltage for the liquid crystal cell 5 is determined with this fixed voltage as a reference. For example in the present embodiment, a positive polarity write voltage is 8V–13V, and a negative polarity write voltage is 1V–6V, and for each polarity the brightness of the pixel can be changed within the range of the difference in potential (1V–6V) from the electrical potential 7V of the common electrode 6.

Also, by applying the drive voltage to any one of the gate lines and thereby switching the connected TFTs 4 ON, the write voltage of the image data supplied through the drain line 3 is applied to the capacity of the liquid crystal cells 5 connected to each TFT 4, and an electric charge is written to this capacity. Furthermore, even when the drive voltage is no longer applied to the gate line and the TFTs 4 are switched OFF, the liquid crystal cell 5 holds the write voltage for the period of one frame before the writing starts again, and the display on the liquid crystal panel 1 is maintained continuously by this holding voltage.

Moreover, the liquid crystal panel 1 comprises two oppositely disposed glass substrates, with the liquid crystal being filled between these glass substrates. On one of the glass substrates the TFTs 4 are arranged and the gate lines 2*n* and the drain lines 3 are also provided. Furthermore, a filter and the common electrode 6 are placed on the other glass substrate, and if the liquid crystal display is a color liquid crystal display, then a color filter for the three primary colors RGB is provided as the filter. In the present specification, discussion will continue based on the assumption that the liquid crystal panel 1 conforms to SXGA (Super eXtended Graphics Array) standard resolution (1280 dots×1024 dots) with a frame frequency of 60 Hz. For each RGB color there will therefore be 1280 drain lines 3 and 1024 gate lines.

Next, a gate driver 7 undertakes the driving in the direction of the scan lines, synchronizing with the clock signal VCK supplied from the timing controller 8 (to be described below), and supplies the drive voltage in a pulse form (hereafter referred to as a "Gate Pulse Signal") in sequence to the gate line 2*n* and the other lines, thereby performing line sequential drive on these gate lines. Consequently, the period for which the gate driver 7 applies the gate pulse signal to each gate line (in other words the pulse width of the gate pulse signal), is the write period for the liquid crystal cell 5.

Furthermore, the gate driver 7 controls whether the gate pulse signal will be supplied to the gate line 2*n* and the like in accordance with an output enable signal /VOE which is supplied from the timing controller 8. If the output enable signal /VOE is low level (hereafter abbreviated to "L"), then the gate driver 7 applies the gate pulse signal to the gate line 2*n* and the like, whereas if the output enable signal /VOE is high level (hereafter abbreviated to "H"), then the gate pulse signal is not applied. Moreover, the symbol "/" signifies an inversion signal.

Next, the timing controller 8 generates a dot clock signal DCK, a latch pulse signal STB, the clock signal VCK, the output enable signal /VOE and the image data, and by outputting each of these to the gate driver 7 and the source driver 9, controls the image display on the liquid crystal panel 1. The details of the timings of these signals will be made clear in the description of the operation, and will therefore not be described in detail here.

The source driver 9 incorporates a shift register, a latch and a driver circuit (none of which are shown in the figure). Moreover, all of these are designed to correspond with one scan line worth of image data (in this case 1280 dots). Based on a start pulse signal SP and the dot clock signal DCK supplied from the timing controller 8, the source driver 9 takes in the image data sequentially into the shift register pixel by pixel and in accordance with the dot clock signal DCK from the point in time where the start pulse signal SP rises.

The source driver 9 halts the intake of data into the shift register at the point in time where image data on one scan line has been received. Furthermore, in the case where the pulse of the latch pulse signal STB has been supplied to the source driver 9 from the timing controller 8, all the image data taken in by the shift register is transferred simultaneously to the latch, synchronized with the rise of the pulse. In addition, the source driver 9, synchronized with the fall in the latch pulse signal STB, converts the image data transferred to the latch to a write voltage for the liquid crystal cell 5 and simultaneously sends this voltage to the drain line 3.

Here, a liquid crystal display according to each embodiment of the present invention uses multiple line inversion drive and dot inversion drive, and this driving method is called "Multiple Line Dot Inversion Drive". For example when a two line dot inversion drive is used, each pixel is driven with the write voltage polarities shown in FIG. 2. FIG. 2 shows the polarity of the voltage of the image data written to each pixel within a certain frame for the proximity of the upper left corner of the liquid crystal panel 1. As shown in the figure, for the n line, a voltage of positive polarity followed by a voltage of a negative polarity is repeatedly written in sequence from the leftmost pixel, and for the n+1 line also, a voltage of exactly the same polarity as the n line is written.

In contrast, for the n+2 line and the n+3 line, a voltage of the opposite polarity to that of the n line and the n+1 line is written, so that a voltage of negative polarity followed by a voltage of a positive polarity is repeatedly written in sequence from the leftmost pixel. For the n+4 line and onward the same cycle of writing is repeated as that of the n line through to the n+3 line. Furthermore, for the frame after the frame shown in FIG. 2, a voltage of the opposite polarity to that mentioned above is sequentially written. For example, for the n line and the n+1 line a voltage of negative polarity followed by a voltage of positive polarity is repeatedly written in sequence from the leftmost pixel.

(2) Description of the Operation

Figure 3:
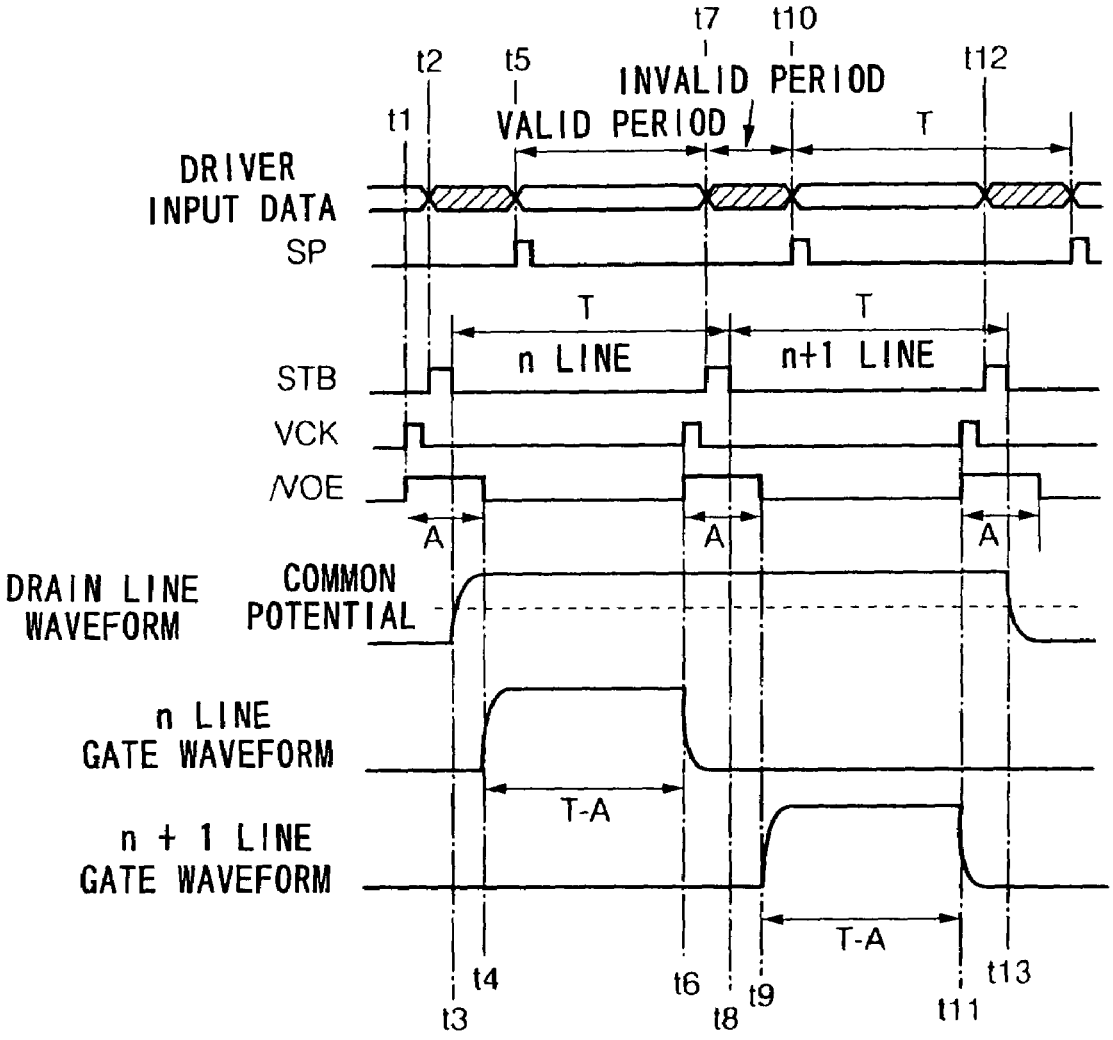
FIG. 3 is a timing chart showing the operation of a liquid crystal display according to a first embodiment of the present invention in the case of two line dot inversion drive.

Next, the operation of the liquid crystal display according to the present embodiment will be described with reference to the timing chart of FIG. 3. FIG. 3 represents a case where two line dot inversion drive such as that shown in FIG. 2 is used. Furthermore in FIG. 3, in order to simplify the depiction of the drain line waveform, the case where a solid display is used is shown, and this is also true for all following drawings. In the present embodiment, in the frame directly before that shown, both the n line and the n+1 line are driven with a write voltage of a negative polarity, and in the frame of the timing shown in FIG. 3, both of these lines are driven with a write voltage of a positive polarity.

In FIG. 3, the term "Driver Input Data" refers to the image data supplied from the timing controller 8 to the source driver 9, where image data on one scan line is supplied, using the time T corresponding with one horizontal period (15.6 $\mu$s in the aforementioned case of SXGA and 60 Hz) as one cycle. Here, one horizontal period comprises a valid period and an invalid period, where for example the valid period is 11.9 $\mu$s , and the invalid period is 3.7 $\mu$s. The valid period is that period where the image data is actually supplied, and furthermore because the 1280 dots of image data on one scan line are taken in during this period, the frequency of the aforementioned dot clock DCK is set at approximately 108 MHz.

In contrast, the invalid period corresponds to the horizontal blanking period used in CRT (Cathode Ray Tube) displays, and is a period which is not by nature necessary in the liquid crystal display, but is included to maintain compatibility with CRT displays. Also, the rise in the pulse applied to the start pulse signal SP is the start of the valid period, and from the point in time when this valid period ends, the invalid period begins. Furthermore, when time T has elapsed from the rise in the start pulse signal SP and a pulse is reapplied to the start pulse signal SP, a new valid period begins.

Firstly, before a time t1, the source driver 9 takes in the image data of the n line in accordance with the dot clock signal DCK. When time t1 is reached, the timing controller 8 generates a pulse in the clock signal VCK. Then, the gate driver 7 shifts the gate pulse signal, synchronized with the rise in the clock signal VCK.

Conventionally the gate driver 7 raises the drive voltage to be supplied to the gate line 2*n*. However in this case, the timing controller 8 generates a pulse with a width of a time A as the output enable signal /VOE from the same time t1. Consequently, the gate driver 7 stops supplying the gate pulse as shown in FIG. 3, the n line gate waveform remains at level "L".

Next, the timing controller 8 generates a pulse in the latch pulse signal STB at a time t2. Because at this time the image data supplied from the timing controller 8 to the source driver 9 shifts from the valid period to the invalid period, the source driver 9 stops the taking in of the image data into the shift register, and transfers the image data on the n line from the shift register to the latch. Moreover, some time is needed from when the clock signal VCK rises to when the gate line waveform has fallen (see for example the n line gate waveform after time t6). Consequently, if the rise in the clock signal VCK is not generated before the fall in the latch pulse signal STB, then the image data of the next line will be taken in instead. As a result, in FIG. 3, the fall in the clock signal VCK is generated earlier than the rise in the latch pulse signal STB by a specific amount of time.

Next, when the timing controller 8 causes the latch pulse signal STB to fall at a time t3, then synchronized with this fall the driver circuit incorporated within the source driver 9 sends a write voltage of a positive polarity corresponding with the image data in the latch to the drain line 3. Here, because until this point the drain line 3 had a write voltage of a negative polarity, by newly applying a write voltage of a positive polarity, the charging for the capacity of the drain line 3 begins. As a result, as shown in FIG. 3, the drain line waveform gradually rises from the time t3, and when a time t4 is reached the voltage of the drain line 3 reaches the write voltage output from the source driver 9.

The timing controller 8 monitors the elapsing of the predetermined time A from the time t1, and restores the level of the output enable signal /VOE to level "L" at the time t4 which corresponds to this elapse of time. Consequently, because the gate driver 7 starts the application of the gate pulse signal to the gate line 2*n*, then as shown in FIG. 3, the n line gate waveform rises. As a result, all of the TFTs 4 connected to the gate line 2*n* are switched ON, and for the liquid crystal cells 5 which are connected to these TFTs, writing occurs with the positive polarity write voltage supplied from the drain line 3.

Here, the time A is determined as the same as the time taken for the drain line waveform to rise from a write voltage of a negative polarity to a write voltage of a positive polarity, or a time which exceeds this time. Theoretically, the value of the time A can be enumerated based on such factors as the load of the liquid crystal panel 1 (the resistance or capacity of the drain line 3) according to the source driver 9 and the drive ability of the source driver 9. However, because there are differences in the characteristics of the liquid crystal panel 1 and the source driver 9 for each device, accurately determining the time A through calculation alone is generally difficult.

Consequently, the value of the time A is actually determined by evaluation. Because of this, the timing controller 8 is designed so that changing the value of the time A from outside the liquid crystal display is possible. Furthermore, while actually operating the liquid crystal display and displaying a predetermined pattern (for example the pattern where the whole screen is solid) on the liquid crystal panel 1, by finely tuning the time A and checking by a visual assessment whether horizontal stripes occur on the screen, the time A is determined as when the horizontal stripes disappear.

Moreover, in FIG. 3, the point where the drain line waveform has finished rising (the time t4) coincides with the fall of the output enable signal /VOE. However, even if the output enable signal /VOE falls earlier than the time t4 (namely, at a point near when the drain line waveform has finished rising), this is not problem if as a result of a visual assessment horizontal stripes cannot be detected. Furthermore, the time t4 may come after the fall in the output enable signa becomes, the less is able to be written to the liquid crystal cell 5, and the brightness drops. Consequently it is preferable for the time A to be the shortest possible time value for which horizontal stripes disappear.

Here, FIG. 4 is a diagram showing the result of a visual assessment of the degree of horizontal stripes when a two line dot inversion drive is implemented with a 60 Hz frame frequency and the SXGA standard. When a tone display of 127 tones is used in the liquid crystal cell 5, then when the time A is 0 $\mu$s faint horizontal stripes can be observed, whereas by increasing the time A to 1.26, 2.5, or 5.0 $\mu$s, the horizontal stripes disappear in all cases. Therefore, with a 127 tone display, the final value of the time A should be determined as 1.26 $\mu$s. In contrast, because when a 63 tone display is used with a time A of 1.26 $\mu$s faint horizontal stripes occur, the final value of the time A should be determined as 2.5 $\mu$s, where the horizontal stripes disappear.

Next, as shown in FIG. 3, when a time t5 is reached, the timing controller 8 generates a pulse in the start pulse signal SP, but to enter the valid period in synchronization with the rise in this pulse, the image data is supplied to the source driver 9. Consequently, the source driver 9 takes the image data sequentially into the shift register in accordance with the dot clock signal DCK. Next, when a time t6 is reached, the timing controller 8 causes the clock signal VCK and the output enable signal /VOE to rise, in the same manner as was observed at the time t1.

Consequently, as a result of the gate driver 7 shifting the gate pulse signal and stopping the supply of the gate pulse signal line 2*n*, then as shown in FIG. 3 the n line gate waveform falls, and writing to the liquid crystal cell 5 which is connected to the gate line 2*n* ceases. As described above, in the scan lines where the polarity of the write voltage is inverted, writing to the liquid crystal cell 5 is performed for the time (T−A). Subsequently, for the n+1 line also, approximately the same manner of operations as for the n line (time t1–t6) are performed at the times t6–t11.

In other words, because the output enable signal /VOE rises at the time t6, the gate driver 7 will not apply the gate pulse signal to the gate line 2*n*+1. Next, when the latch pulse signal STB rises at the time t7, the taking in of the image data from the n+1 line stops, and at the time t8 when the latch pulse signal STB falls, a write voltage corresponding with the image data of the n+1 line taken in up to that point is applied to the drain line 3. Here, in the n+1 line the drain line 3 is already charged with a write voltage of a positive polarity, and at the time t8–t9 there is no rise in the drain line waveform like that present at the time t3–t4.

Next, when the output enable signal /VOE falls at the time t9, the gate pulse signal is then applied to the gate line 2*n*+1, and writing to the liquid crystal cell 5 connected to this gate line begins. Subsequently, at a time t10, the intake of the image data of the n+2 line begins. Furthermore, at a time t11 the gate pulse signal shifts and the supply of the gate pulse signal to the gate line 2+1 stops, and the writing to the liquid crystal cell 5 connected thereto ceases. As described above, for the n+1 line also, writing is performed for the time (T−A).

When at the same time t11 two scan lines of writing ends, then for the scan lines from n+2 line onward, writing is performed in the same manner as for the n line and the n+1 line. Here, because with the present embodiment two line dot inversion drive is used, then as shown at the time t13 in FIG. 3, in the n+2 line the drain line 3 is driven with a write voltage of a negative polarity, and as shown in FIG. 3 the drain line waveform changes from a write voltage of a positive polarity to a write voltage of a negative polarity. Moreover, the write operation for the n+2 line and the n+3 line is the same as that for the n line and the n+1 line, with the exception that the voltage of the drain line waveform becomes a write voltage of a negative polarity.

According to the present embodiment described above, in the scan lines where the polarity of the write voltage is inverted, the output of the gate driver 7 is masked so that the drive voltage is not applied to the gate line in the rising or the falling period of the drain line 3. At the point in time where the drain line waveform has finished rising and has flattened out, the gate pulse signal is applied to the gate line, and writing to the liquid crystal cell 5 commences. Furthermore, in each subsequent scan line where writing is performed with the same polarity, the write period taken is the same as that of the scan lines where the polarity of the write voltage is inverted.

Figure 9:
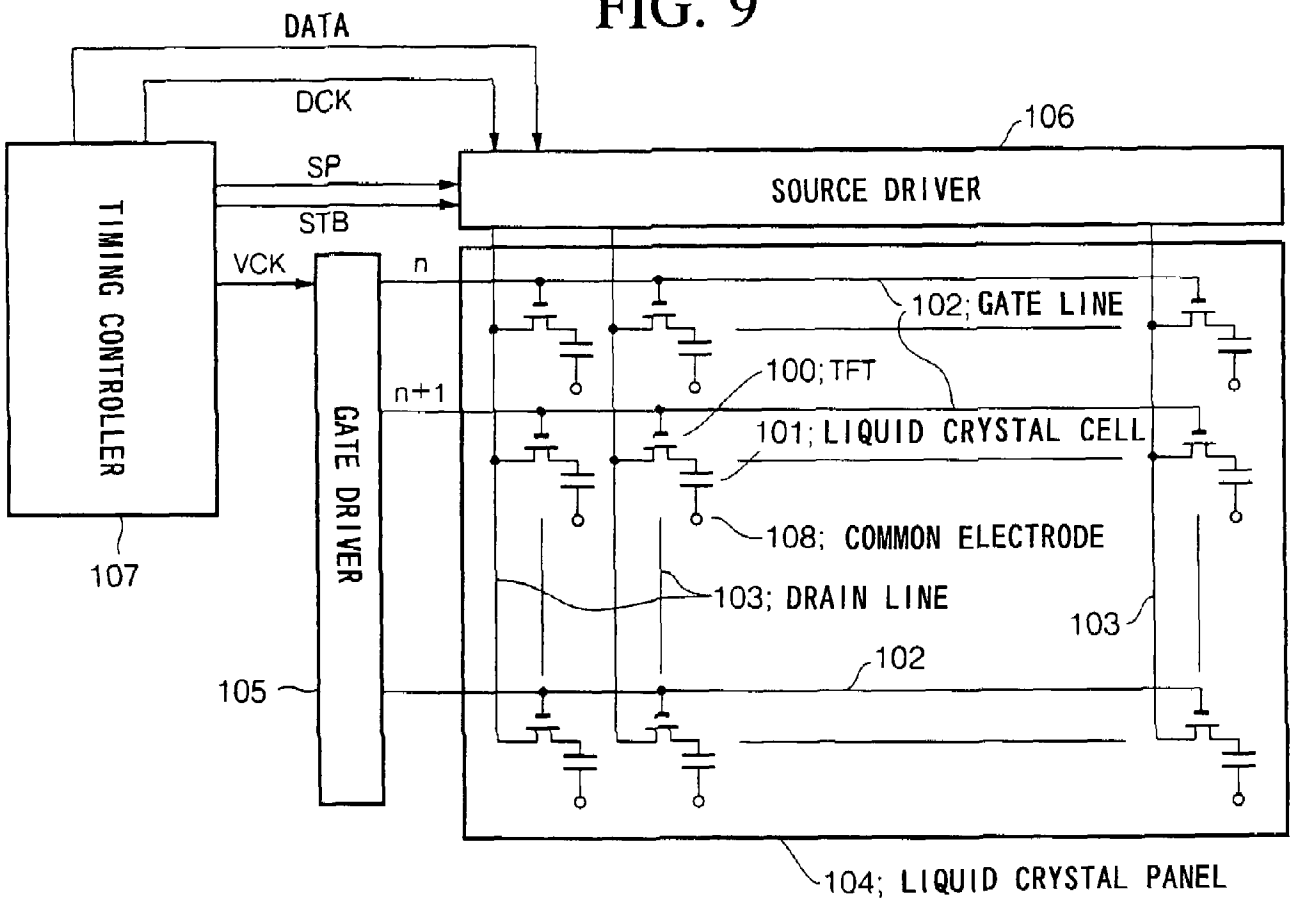
FIG. 9 is a block diagram showing the construction of essential sections of a liquid crystal display according to related art.

Consequently, the write state for the liquid crystal cells 5 can be made equal for all the scan lines written with the same polarity. As a result, because the write voltage applied to the liquid crystal cells 5 becomes identical for all the scan lines, the difference in brightness between the scan lines disappears and horizontal stripes no longer occur. In addition, when compared with conventional liquid crystal displays (see FIG. 9), then with the present invention, in addition to the generation logic for the output enable signal /VOE being provided in the timing controller 8, only the logic for controlling whether the write voltage will be supplied to each of the gate lines by the gate driver 7 in accordance with the output enable signal /VOE needs to be provided.

Moreover, the above example was described for two line dot inversion drive, but when multiple line dot inversion drive of three lines and over is used, the operation is the same. In other words, for the third scan line and onward that are driven with a write voltage of the same polarity, the drain line 3 is already charged and discharged with the same polarity, as was the case for the second scan line. Consequently, the same manner of operations as for the second scan line at the times t6–t11 shown in FIG. 3 are also used for the third scan line onward.

[Second Embodiment]

The basic structure of a liquid crystal display according to the present embodiment is the same as the first embodiment (see FIG. 1), although in the present embodiment the timing control of the signal in the timing controller 8 differs from the first embodiment. As follows is a description of the specifics of the operation of the liquid crystal display, but with the present embodiment there is some difference between the case where two line dot inversion drive is used and the case where a line inversion drive of three lines or more is used.

(1) Two Line Dot Inversion Drive

Firstly, the operation of two line dot inversion drive will be described with reference to the timing chart of FIG. 5. Moreover, in FIG. 5, those times which correspond with the times shown in FIG. 3 are labeled with the same time labels. Furthermore with the present embodiment, in the frame directly before that shown by the timing in FIG. 5, both the n line and the n+1 line are driven with a write voltage of a negative polarity.

Firstly, when time t1 is reached the timing controller 8 generates a pulse in the clock signal VCK. However, in this case, unlike in the first embodiment, the timing controller 8 does not generate a pulse in the output enable signal /VOE at the same time t1. As a result, the gate driver 7 shifts the gate pulse signal in synchronization with the rise in the clock signal VCK, and as a result of supplying the gate pulse signal to the gate line 2*n*, the voltage of the gate line 2*n* rises from the same time t1. However, at this point in time, the source driver 9 is in the process of taking in the image data of the n line, and the drain line 3 is in a state where a write voltage of a negative polarity corresponding with the image data of the n−1 line has been applied.

Next, the write operation for the n line for the time t2 and onwards is generally the same as that for the first embodiment. Namely, when the latch pulse signal STB rises at the time t2, the intake of the image data ceases, and when at the time t3 the latch pulse signal STB falls, a write voltage of a positive polarity corresponding with the image data of the n line is supplied to the drain line 3. In this case, with the present embodiment, because the gate pulse signal is already being supplied to the gate line 2*n* at the time t1, writing to the liquid crystal cell 5 corresponding with the gate line 2*n* starts from the same time t3.

Next, when the start pulse signal SP rises at the time t5, the intake of the image data of the n+1 line begins. When the time T has elapsed from the time t1 and the time t6 is reached, the timing controller 8 again generates a pulse in the clock signal VCK. However, at this time, the timing controller 8 also generates a pulse in the output enable signal /VOE, in contrast to the case of the n line.

Consequently, the gate line driver 7 shifts the gate pulse signal and as well as stopping the supply of the gate pulse signal to the gate line 2*n*, also does not supply the gate pulse signal to the gate line 2*n*+1. Consequently, the writing of data to the liquid crystal cell 5 corresponding with the gate line 2*n* finishes at the same time t6. As described above, with the present embodiment, the write period for the scan lines where the polarity of the write voltage is inverted is the time T.

Subsequently, the operation is the same as that for the n+1 line in the first embodiment. However, with the present embodiment, a time A2 is used instead of the time A as the pulse width for the output enable signal /VOE, and a time $t9_2$ is used instead of the time t9 as shown in FIG. 3 as the time when the n+1 line gate waveform rises. Furthermore, the value of the time A2 is, in the same manner as the time A in the first embodiment, determined by a visual assessment as the lowest value where horizontal stripes cannot be seen on the screen. Furthermore, when the latch pulse signal STB rises at the time t7, the intake of the image data of the n+1 line ceases, and when the latch pulse signal STB falls at the time t8, the write voltage corresponding with the image data of the same line is supplied to the drain line 3.

Next, at the time $t9_2$ when the time A2 has elapsed since the time t6, then when the timing controller 8 causes the output enable signal /VOE to fall, the gate driver 7 applies the gate pulse signal to the gate line $2n+1$ and starts the writing to the liquid crystal cell 5. Subsequently, the writing to the gate line $2n+1$ continues until the clock signal VCK rises and the n+1 gate line waveform falls at the time t11. In the above manner, the write period for the n+1 line becomes the time (T−A2). Moreover, from the time t11 the writing occurs for the n+2 line and onwards, and for example the write operation for the n+2 line and the n+3 line is the same as that for the n line and the n+1 line, except that the voltage of the drain line waveform becomes a write voltage of a negative polarity.

(2) Three Line Dot Inversion Drive

Next, the specifics of the write operation in the case of three line dot inversion drive will be described with reference to the timing chart in FIG. 6. Moreover, in FIG. 6, those times which correspond with the times shown in FIG. 5 are labeled with the same time labels. In the case of three line dot inversion drive also, the operations at the times t1–t11 are exactly the same as the operations for the same times in FIG. 5.

Figure 5:
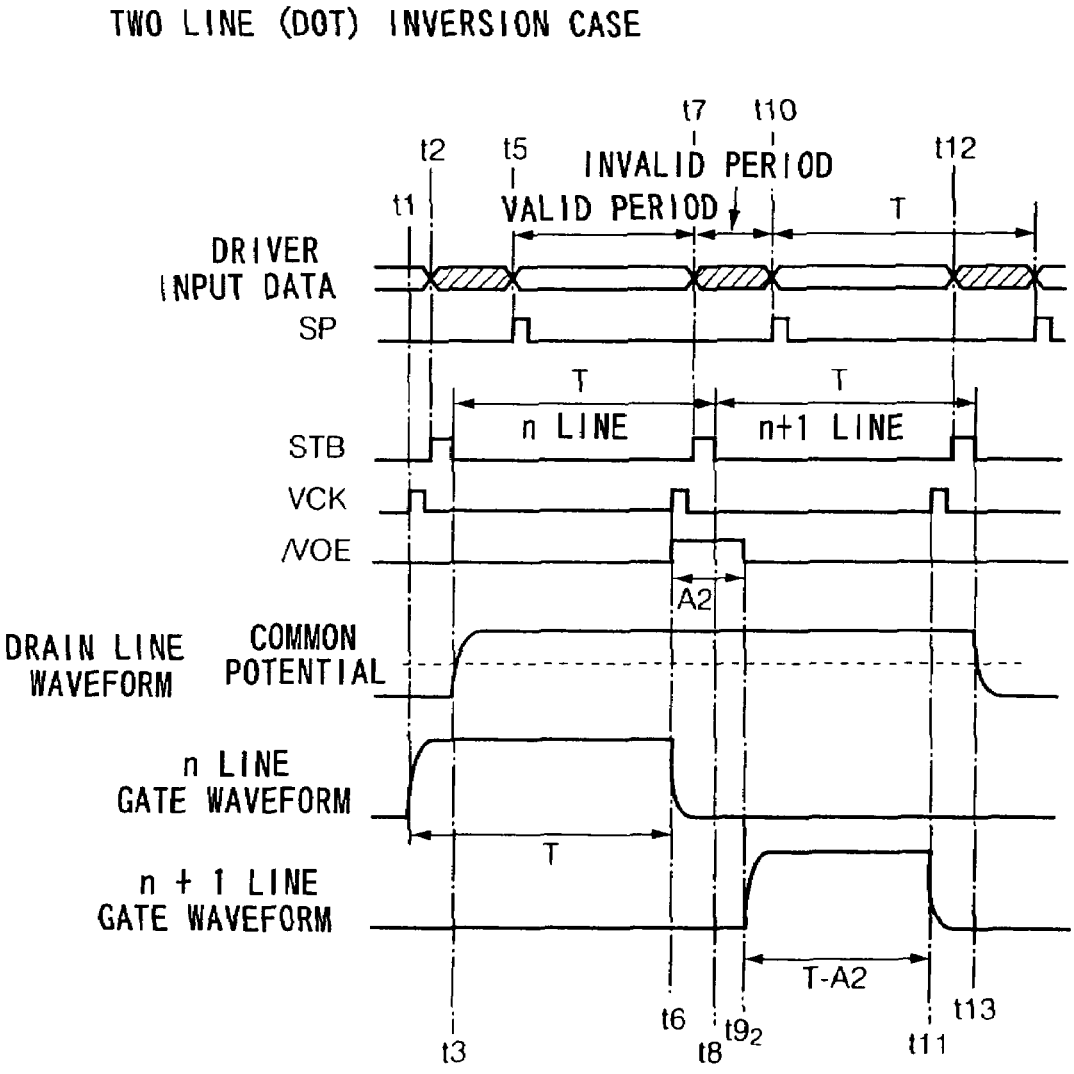
FIG. 5 is a timing chart showing the operation of a liquid crystal display according to a second embodiment of the present invention in the case of two line dot inversion drive.
Figure 6:
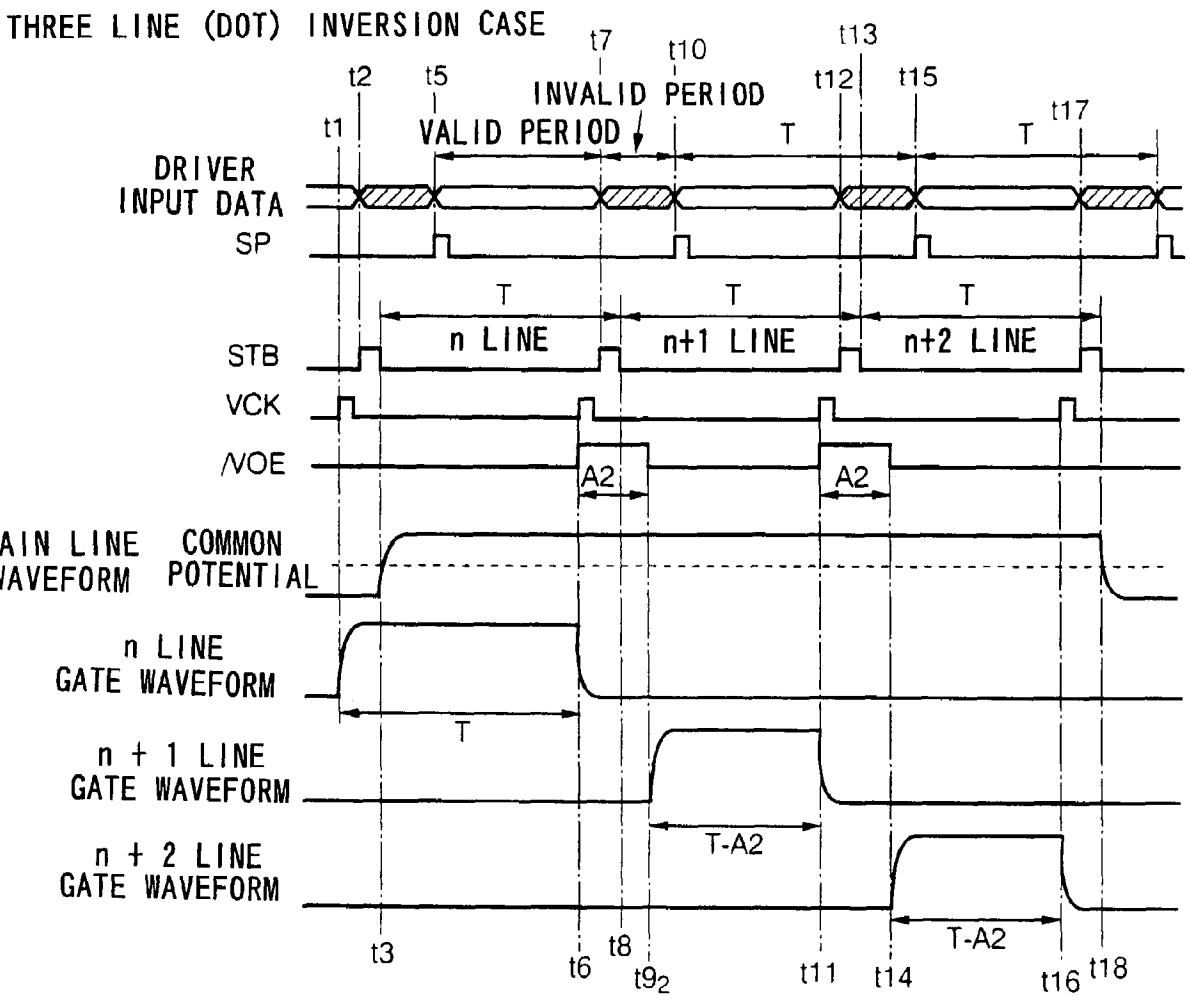
FIG. 6 is a timing chart showing the operation of a liquid crystal display according to the same embodiment in the case of three line dot inversion drive.

At times t11–t18, a write operation using a write voltage of the same positive polarity is executed for the n+2 line, but the operations during this period, excluding the point where the object of the writing is not the n+1 line but the n+2 line, are the same as the operations at the times t6–t13 shown in FIG. 5. In brief, in the scan lines other than those scan lines where the polarity of the write voltage is inverted, because the drain line 3 is already charged with a write voltage of a positive polarity, the write period for all such lines should be set as the time (T−A2). This situation is the same when line dot inversion drive methods of four lines or more are used.

As described above, in the present embodiment, in as much as the writing to the n line is insufficient due to the influence of the rise in the drain line, the write periods for the scan lines from the n+1 line onwards which are driven with a write voltage of this same polarity are equally shortened. Consequently, for example with two line dot inversion drive, in the writing to the n+1 line, the rise timing of the gate pulse signal which is supplied to the gate line $2n+1$ is delayed by the time A2 by the output enable signal /VOE. By so doing, it becomes possible for all scan lines to have the same write state, and horizontal stripes caused by a difference in brightness between the scan lines no longer occur.

Furthermore according to the present embodiment, the write period of the n line remains as the time T equivalent to one horizontal period in the same manner as a liquid crystal display according to related art, and the write periods of lines n+1 and onward change accordingly. In other words, because the write period is the maximum possible within the range where horizontal stripes do not occur, the lowering in brightness caused by the narrowing of the write period can be kept to a minimum. Furthermore the present embodiment offers the same advantage as the first embodiment in that it can be realized by minor additions and alterations to the structure of a conventional liquid crystal display (see FIG. 9).

[Third Embodiment]

The basic structure of a liquid crystal display according to the present embodiment is the same as for the first embodiment (see FIG. 1), and as in the second embodiment, the timing control of the signal in the timing controller 8 differs from the first embodiment. The specific operation of a liquid crystal display according to the present embodiment will be described below, but in the present embodiment also, the operation differs slightly when two line dot inversion drive is used and when a line dot inversion drive method of three or more lines is used.

(1) Two Line Dot Inversion Drive

Figure 7:
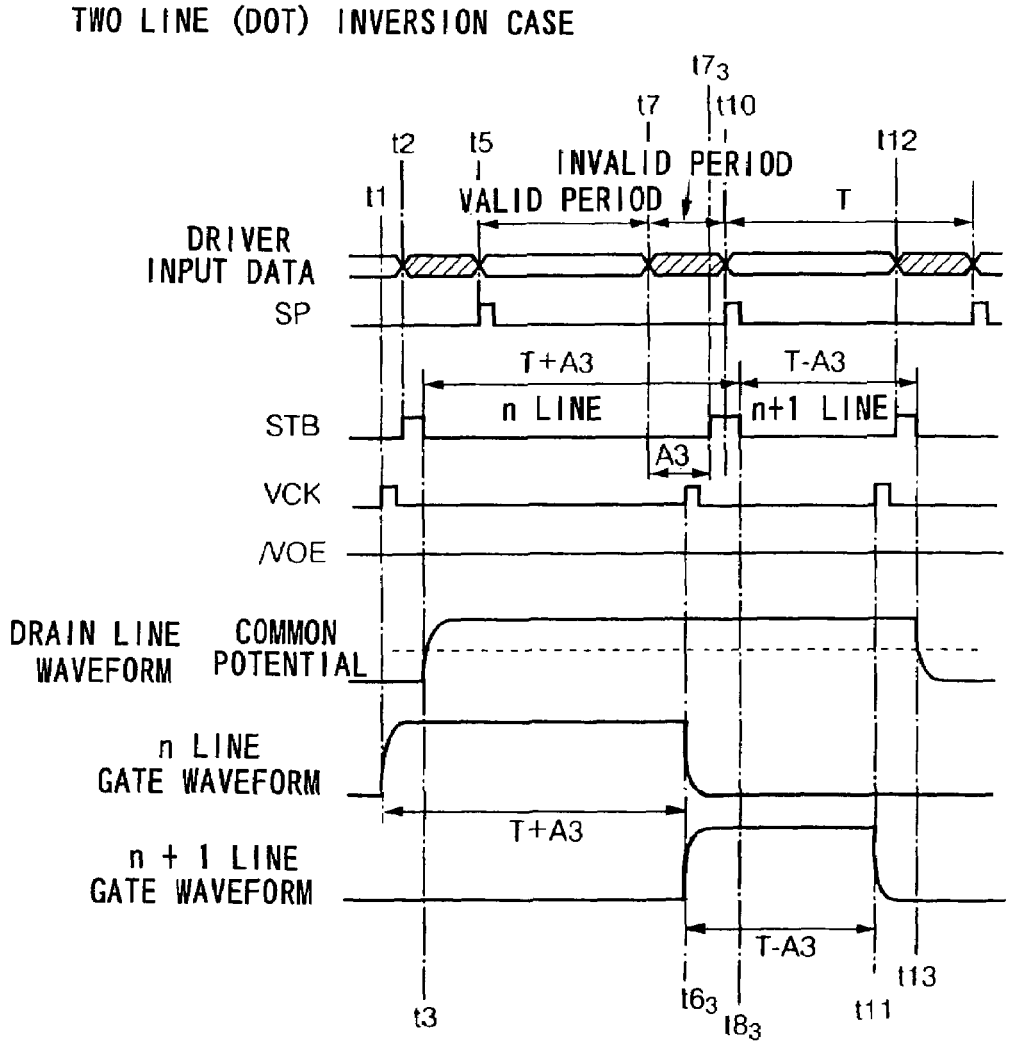
FIG. 7 is a timing chart showing the operation of a liquid crystal display according to a third embodiment of the present invention in the case of two line dot inversion drive.

Firstly, the specific operation in the case of two line dot inversion drive will be described with reference to the timing chart in FIG. 7. In FIG. 7, those times which correspond with the times shown in FIG. 3 (the first embodiment) or FIG. 5 (the second embodiment) are labeled with the same time labels. Furthermore, with the present embodiment, in the frame directly before that shown in the timing in FIG. 7, both the n line and the n+1 line are assumed to be driven with a write voltage of a negative polarity. In addition, because in two line dot inversion drive the output enable signal /VOE is not used, the timing controller 8 maintains the output enable signal /VOE at level "L".

Firstly, the operations at the times t1–t5 are the same as the operations in the second embodiment for these same periods, whereas the operations after this time t5 differ from the second embodiment. In other words, even when the time T has elapsed from the time t1, the timing controller 8 does not generate a pulse in the clock signal VCK. In the same manner, even when the time T has elapsed from the time t2 and the time t7 is reached, the timing controller 8 does not generate a pulse in the latch pulse signal STB. As a result, at the time t7, the data input to the source driver 9 switches to the invalid period, and only the operation that stops the intake of the image data of n+1 line is performed.

Next, when the time (T+A3) has elapsed from the time t1 and a time $t6_3$ is reached, the timing controller 8 generates a pulse in the clock signal VCK which is delayed by the time A3 from the time used in the first embodiment and the second embodiment. Here, the value of the time A3 can be changed within the range of $0 \leqq A3 \leqq$(the time span of the invalid period). Furthermore, the value of the time A3, in the same manner as the time A and the time A2 in each of the aforementioned embodiments, should be determined within the aforementioned range, by choosing the minimum value where a visual assessment shows a screen with no horizontal stripes.

When the clock signal VCK rises at the time $t6_3$, the gate driver 7 causes the gate pulse signal to shift and stops the gate pulse signal being supplied to the gate line $2n$. In this manner, the write period for the n line for the present embodiment is the time (T+A3). Because the output enable signal /VOE is always at level "L" as described above, at the same time $t6_3$ the gate driver 7 starts the supplying of the gate pulse signal to the gate line $2n+1$. Next, when the time A3 has elapsed from the time t7 and a time $t7_3$ is reached, the timing controller 8 generates the latch pulse signal STB.

Consequently, in synchronization with the rise in the latch pulse signal STB, the source driver 9 transfers to the latch the image data of the n+1 line which was taken into the shift register up until the time t7. Next, the timing controller 8 generates the start pulse signal SP at the time t10, and the source driver 9 starts the intake of the image data of the n+2 line. Moreover, because the time A3 is restricted to a value within the range of the invalid period, the rise in the latch pulse signal STB will never occur after the rise in the start pulse signal SP. Consequently, inside the source driver 9, once the contents of the shift register have been transferred to the latch, new image data can be taken into the shift register.

Next, when the time (T+A3) has elapsed from the time t3 and a time $t8_3$ is reached, the timing controller 8 causes the latch pulse signal STB to fall after a delay of the time A3 from the time used in the first embodiment and the second embodiment. As a result, the source driver 9 supplies the write voltage corresponding with the image data of the n+1 line to the drain line 3. At this time, because the gate pulse signal is already being applied to the gate line 2*n*+1 from the time $t6_3$, writing to the liquid crystal cell 5 corresponding with the gate line 2*n*+1 begins from the same time $t8_3$.

The subsequent operations are the same as the first embodiment and the second embodiment. In other words, when the clock signal VCK rises at the time t11, the supply of the gate pulse signal to the gate line 2*n*+1 ceases, and the writing for this gate line finishes. In this manner, in the present embodiment the write period for the n+1 line becomes the time (T−A3). Subsequently, when the latch pulse signal STB rises at the time t12, the intake of the image data of the n+2 line ceases, and when the latch pulse signal STB falls at the time t13, a write voltage of a negative polarity corresponding with the image data of the n+2 line is supplied to the drain line 3.

(2) Three Line Dot Inversion Drive

Figure 8:
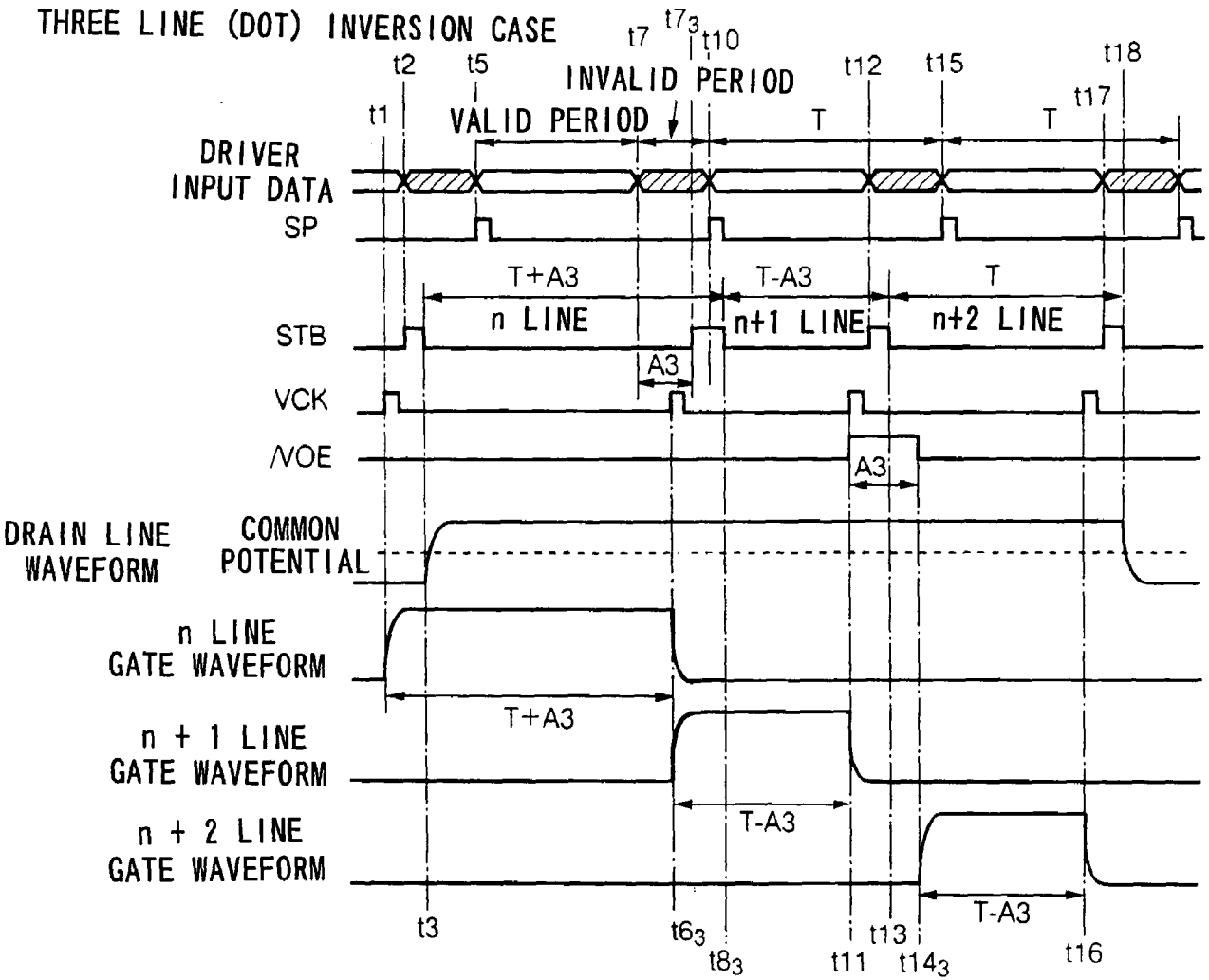
FIG. 8 is a timing chart showing the operation of a liquid crystal display according to the same embodiment in the case of three line dot inversion drive.

Next, the specific operation in the case of three line dot inversion drive will be described with reference to the timing chart in FIG. 8. Moreover, in FIG. 8 those times which correspond with the times shown in FIG. 6 (the second embodiment) or FIG. 7 are labeled with the same time labels. In this case also, the operations for the times t1–t13 are the same as the operations for within exception of the points described below.

Specifically, in this case, at the same time as the clock signal VCK rises at the time t11, the timing controller 8 shifts the output enable signal /VOE to level "H". This shift is to make the write period of the n+2 line the same time (T−A3) as that of the n+1 line. Consequently, the gate driver 7, in addition to stopping the supply of the gate pulse signal to the gate line 2*n*+1 and ending the writing to the n+1 line, also stops the gate pulse signal being supplied to the gate line 2*n*+2 (omitted in the figure).

At the point when the time A3 has elapsed from the time t11 and a time $t14_3$ is reached, the timing controller 8 causes the output enable signal /VOE to fall. Consequently, the gate driver 7 supplies the gate pulse signal to the gate line 2*n*+2. At this time, because the write voltage of a positive polarity corresponding with the image data of the n+2 line is already being applied to the drain line 3 from the time t13, writing to the liquid crystal cell 5 corresponding with the gate line 2*n*+2 begins at the same time $t14_3$. Next, when the start pulse signal SP rises at the time t15, the intake of the image data of the n+3 line begins.

The subsequent operations are generally the same as for the n+1 line. That is, the supply of the gate pulse signal to the gate line 2*n*+2 is stopped by the clock signal VCK rising at the time t16, and the gate pulse signal is supplied to the gate line 2*n*+3 (omitted in the figure). Subsequently, the latch pulse signal STB rising at the time t17 causes the intake of the image data of the n+3 line to ease, and the latch pulse signal STB falling at the time t18, causes write voltage of a negative polarity corresponding with the image data of the n+3 line to be supplied to the drain line 3. In this manner, in the case of a line dot inversion drive of three lines and over, then for the lines from the n+2 line onward, in order to standardize the write state with the n+1 line, the rise in the gate pulse signal supplied to the gate line is delayed by the time A3.

As described above, the cycles of the clock signal VCK and the latch pulse signal STB in the first embodiment and the second embodiment were a constant time T. In contrast, in the present embodiment, between the n line and the lines from the n+1 line onward, the cycles of the clock signal VCK and the latch pulse signal STB can be changed in combination. In other words, a longer write period is taken in the n line which incorporates the rise period of the drain line waveform, whereas in the n+1 line and onward where the drain line waveform is flat, the write period is shortened. As a result, the write state of the scan lines where the polarity of the write voltage is inverted can be made the same as that of the following scan lines. Consequently, the difference in brightness between the scan lines disappears, and the occurrence of horizontal stripes can be prevented.

Furthermore, according to the present embodiment, the range within which the cycle of the clock signal VCK and the latch pulse signal STB can be changed is assigned a limit similar to that required for restriction within the invalid period of the driver input data. Here, if the cycles of these signals are temporarily made to be variable without any restrictions being attached, then the valid period becomes shorter by a period which is outside the range of the invalid period. Consequently, image data for one horizontal period must be taken in a time shorter (for example 10 $\mu$s) than the conventional valid period (11.9 $\mu$s). Because this would require the frequency of the dot clock signal to be raised, the type of problem described in the "Description of the Related Art" section arises. In contrast, according to the present embodiment, all of the image data can be taken in within the same valid period as the first embodiment and the second embodiment, and there is no need to change the frequency of the dot clock signal DCK.

In addition, according to the present embodiment, if two line dot inversion drive is used, then simply adjusting the timing of the latch pulse signal STB and the clock signal VCK is sufficient. Consequently, two line dot inversion drive can be realized by making some minor changes to the structure of the timing controller. Furthermore, because in this case there is no need to control the timing of the output enable signal /VOE, an additional advantage arises in that the control of the timing controller 8 is simplified. In contrast, when a line dot inversion drive of three lines or more is used, then as well as providing the generation logic for the output enable signal /VOE in the timing controller 8, the logic that determines whether the drive voltage will be supplied to each gate line in accordance with the output enable signal /VOE, should be provided in the gate driver 7.

[Examples of Variations]

(1) Each of the aforementioned embodiments was described using multiple line dot inversion drive as a premise, but the present invention applies in exactly the same manner with simple multiple line inversion drive.

(2) Furthermore, the above description was based on a structure using TFTs, but a structure using MIM (Metal Insulator Metal) diodes in place of TFTs may also be adopted. The present invention can also be applied to a structure where the holding capacity for each liquid crystal cell is provided externally and in a parallel arrangement.

Figure 10:
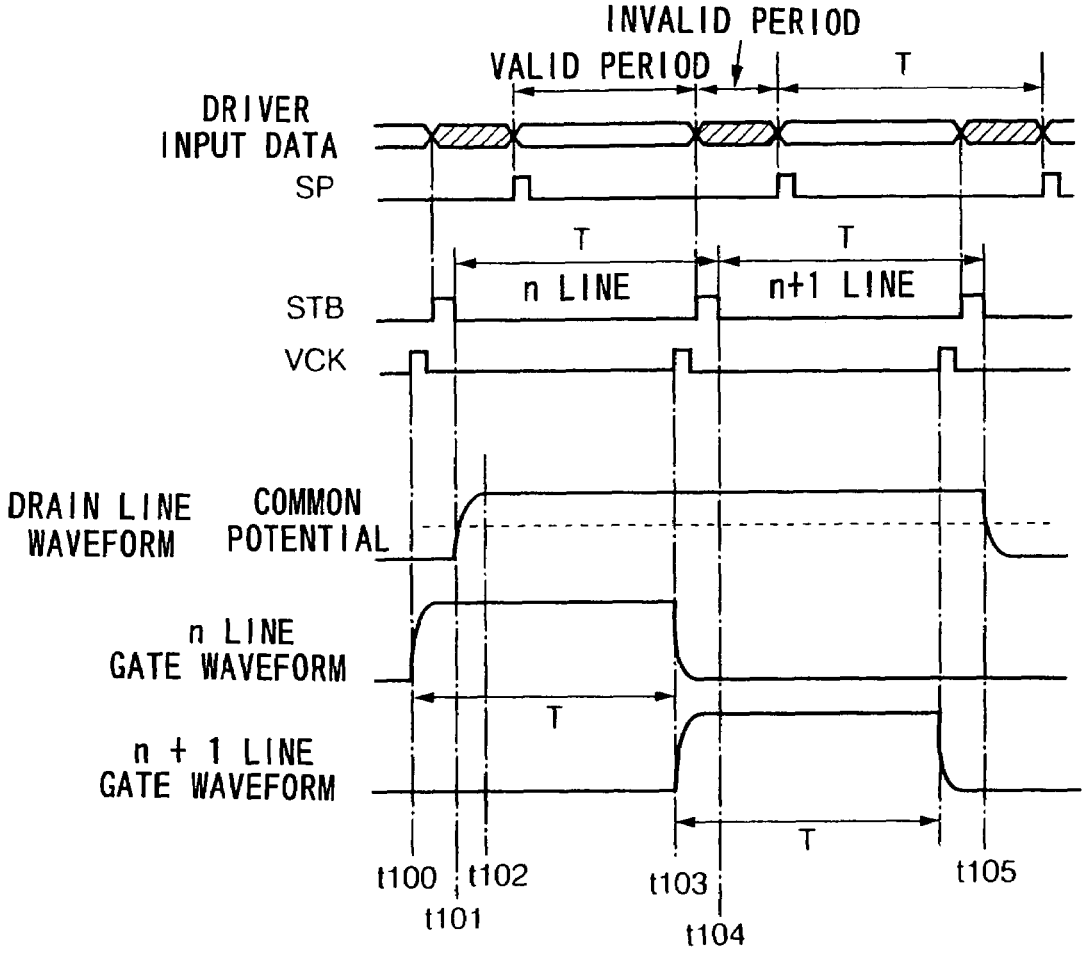
FIG. 10 is a timing chart showing the operation of a liquid crystal display according to related art in the case of two line dot inversion drive.

(3) In addition, each of the aforementioned embodiments is based on a structure of related art (refer to FIG. 10) where the drive signal and the write voltage are supplied to the gate line and the drain line respectively for a time T, and the present invention was described as it applies to this related art structure. However, the time for which the drive signal and the write voltage are supplied does not necessarily have to be the time T, and for example the present invention may be applied to a structure where the drive signal and the write voltage are supplied for a period of time (T−α) which is shorter than the time T by a predetermined time α.

What is claimed is:

1. A liquid crystal display device, comprising:

pixels equipped with a liquid crystal cell and a switch element, which are arranged at positions where scan lines and data lines intersect;

a data line drive circuit for supplying, from said data line and said switch element to said liquid crystal cell, a write signal corresponding with image data;

a control circuit for inverting a polarity of said write signal after every plurality of scan lines; and a scan line drive circuit which supplies a drive signal to said scan lines and switches said switch elements ON and OFF, while maintaining a constant horizontal scanning period, so that, of the plurality of scan lines to which is supplied a write signal of a same polarity, in following scan lines other than those scan lines where the polarity of said write signal is inverted, said drive signal is supplied for a period of time that is shorter, by a predetermined amount of time, than a time for which said drive signal is supplied to scan lines where the polarity of said write signal is inverted.

2. A liquid crystal display device according to claim 1, where said scan line drive circuit adjusts a period for which said drive signal is supplied, in accordance with an output enable signal for controlling whether or not to supply said drive signal to said scan line.

3. A liquid crystal display device, comprising:

a plurality of pixels, a pixel being located where scan lines and data lines intersect, each said pixel comprising a liquid crystal cell and a switching element;

a data line drive circuit supplying a write signal corresponding with image data;

a control circuit providing a polarity inversion of said write signal after a predetermined plurality of scan lines; and means for supplying a drive signal to said scan lines for switching said switch elements to first and second positions, while maintaining a constant horizontal scanning period, so that, of the plurality of scan lines to which is supplied a write signal of a same polarity, in following scan lines other than those scan lines where the polarity of said write signal is inverted, said drive signal is supplied for a period of time that is shorter, by a predetermined amount of time, than a time for which said drive signal is supplied to scan lines where the polarity of said write signal is inverted.

4. A liquid crystal display device according to claim 3, further comprising:

means to permit a precharging of drain lines for said write signal during those scan lines when the polarity of said write signal is first inverted.

5. A liquid crystal display device according to claim 3, wherein said means for supplying said drive signal provides an output enable signal for controlling whether or not to supply said drive signal to said scan line.

6. A liquid crystal display device according to claim 3, wherein said shorter period is achieved by a correction to a clock signal used to activate gate lines of said switching elements in a scan line.

7. A liquid crystal display device according to claim 3, wherein said means for supplying said drive signal receives an input representing an adjustment for a time delay, said adjustment being selected to reduce at a difference of brightness between scan lines.

8. A method to reduce a difference in a brightness between scan lines in a liquid crystal display device having a polarity inversion of write signals after a predetermined plurality of said scan lines, said method comprising:

providing a timing adjustment as an input into a scan line drive circuit that provides a drive signal to said scan lines for switching switch elements to first and second positions in said scan lines, while maintaining a constant horizontal scanning period, so that, of the plurality of scan lines to which is supplied a write signal of a same polarity, in following scan lines other than those scan lines where the polarity of said write signal is inverted, said drive signal is supplied for a period of time that is shorter, by a predetermined amount of time, than a time for which said drive signal is supplied to scan lines where the polarity of said write signal is inverted.

9. The method of claim 8, wherein said liquid crystal display device precharges drain lines for said write signal as an initial operation for those scan lines in which the polarity of said write signal is first inverted.

10. The method of claim 8, wherein said drive signal provides an output enable signal for controlling whether or not to supply said drive signal to said scan line.

11. The method of claim 8, wherein said shorter period is achieved by a correction to a clock signal used to activate gate lines of said switching elements in a scan line.

* * * * *